United States Patent [19]

Haddad

[11] 4,376,404

[45] Mar. 15, 1983

[54] APPARATUS FOR TRANSLATING SOUND INTO A VISUAL DISPLAY

[75] Inventor: Albert G. Haddad, Chapel Hill, N.C.

[73] Assignee: Agricultural Aviation Engineering Co., Las Vegas, Nev.

[21] Appl. No.: 200,004

[22] Filed: Oct. 23, 1980

[51] Int. Cl.[3] ..... A63J 17/00; F21P 7/00

[52] U.S. Cl. ..... 84/464 R; 239/18; 137/624.11

[58] Field of Search ..... 84/464; 239/16–18; 315/365; 40/406, 407, 457; 137/624.11; 360/79

[56] References Cited

U.S. PATENT DOCUMENTS

| | | | |
|---|---|---|---|
| 2,868,055 | 1/1959 | Simos | 84/464 |
| 3,165,966 | 1/1965 | Pribyl | 84/464 |
| 3,292,861 | 12/1966 | Kawamura et al. | 239/17 |
| 3,294,322 | 12/1966 | Kawamura | 84/464 |
| 3,461,457 | 8/1969 | Kawamura et al. | 179/100.2 |
| 3,530,888 | 9/1970 | Cable | 137/624.11 |

*Primary Examiner*—Stafford D. Schreyer

*Attorney, Agent, or Firm*—Jack M. Wiseman; Francis W. Anderson

[57] ABSTRACT

Apparatus for translating sound into a visual display comprising means for producing audio signals. The audio signals are advanced over a plurality of paths. Over one path, the audio signals are detected for voltage amplitude. Should the voltage amplitude fall within a predetermined range, a valve is operated to control the flow of liquid from a pump to a set of nozzles. Over another path, the audio signals are detected by tone detectors for dominant notes falling within various frequency bands representative of the melody of the audio signals. A resultant voltage is a function of the band of frequencies over which the dominant notes are detected. The flow of liquid from a set of nozzles is proportional to the amplitude of the voltage resulting from the band of frequencies over which the dominant notes are detected. Lamps of various colors are selectively illuminated in accordance with the band of frequencies over which the dominant notes are detected. Lastly, audio signals are advanced through a band pass filter for the detection of bass tones. A pulse or spike signal is formed from the audio signals passing through the band pass filter each time a beat is detected. Each time a pulse or spike signal is formed, a suitable valve is activated so that nozzles discharge liquid in a pulsating manner in rhythm with a beat of the audio signals. The pulse or spike signals are fed to a counter and a voltage output network to control the speed of a motor so that the movement of the nozzles is in rhythm with the audio signals.

32 Claims, 8 Drawing Figures

0
35
36
37
30
27
80
75
75a
75b
75c
75d
75e
75f
81
82
83
84
85
86
87
88
89
90
91
92
93
94
95
96
97
98
99
100
101
c
d
e
f
g
h
19
17
16
18
15
20
25
70a
70b
70c
70d
70e
70f
70
c
b
a

| | |
|---|---|
| 2A | 2B |
| 2D | 2C |

BEAT DETECTOR
TO RELAY 185
BINARY COUNT
TO MOTOR 230
LATCH
CLR
CL
Q
+5V
P
Q
R
N
T
U
V
W
X
Y

APPARATUS FOR TRANSLATING SOUND INTO A VISUAL DISPLAY

BACKGROUND OF THE INVENTION

The present invention relates in general to visual displays, and more particularly to a visual display translated from sound.

The patent to Simos U.S. Pat. No. 2,868,055, issued on Jan. 13, 1959, for Audio Frequency Controlled Fountain, discloses the use of filters to separate electrical audio signals into a plurality of discrete bands of frequencies within the audio range. The patent to Simos describes a plurality of band pass filters. In the patent to Simos, audio signals are amplified and rectified. Variations in amplitude of the audio signals produce variable d.c. voltages. The d.c. voltages are applied to a pump motor so that the height of the water discharged by nozzles reflect variations in amplitude of the audio signals.

In the patent to Pribyl, U.S. Pat. No. 3,165,966, issued on Jan. 19, 1965, for Fountain Displays, there is disclosed a fountain display in which the frequency component of audio signals controls the amplitude of the fountain spray and varies the intensity of colored lamps.

The patent to Kawamura et al., U.S. Pat. No. 3,292,861, issued on Dec. 20, 1966, for Control Device of Dynamic Operation And Colored Illumination Of Water Fountains In Synchronism With Music discloses an organ-type console in which water fountain nozzles are operated through the organ-type console and in which lamps are illuminated through the operation of the organ-type console.

As to the patent to Kawamura et al. U.S. Pat. No. 3,294,322, issued on Dec. 27, 1966, for Device For Automatically Controlling Water Jets Of Artificial Fountains In Synchronism With Musical Sounds, there is disclosed apparatus for producing audio signals. A fountain includes water nozzles and lamps. Filters are employed to separate the audio signals into respective frequency bands. A discriminating circuit detects the beat of the audio signals and produces pulse signals. A circuit responsive to the filtered signals and the beat signals controls the illumination of lamps in synchronism with the volume of discharge of water from water jets.

The patent to Cable, U.S. Pat. No. 3,530,888, issued on Sept. 29, 1970, for Sound Actuated Fluid Flow Control Apparatus discloses apparatus in which valves are actuated to control the flow of liquid by a transducer that is responsive to audio signals.

In the patent to Kawamura et al., U.S. Pat. No. 3,461,457, issued on Aug. 12, 1969, for Device For Recording Signals For Controlling Water Fountains, there is disclosed apparatus for recording, modifying and reproducing signals for controlling water fountains. The electrical signals are sampled as a number of simultaneous control signals and are pulsed at predetermined time intervals. A shift register converts the sampled signal pulses into a series of sequential control signals and reconverts the pulse signals into simultaneous pulse signals. The patent to Kawamura et al., U.S. Pat. No. 3,461,457, discloses employing digitized control signals sensed from a magnetic tape and processing the digitized control signals for direct control over actuating devices for water fountains.

SUMMARY OF THE INVENTION

Apparatus for translating sound into a visual display in which visual devices are varied in a pulsating manner in accordance with the beat of the audio signals and the audio signals are within a band of frequencies in which the beat rhythm tones appear.

An object of the present invention is to recapture visually the tempo of audio signals and the implicit rhythm of the rhythmic beat. The explicit beat is reflected in visual variations of a visual display and the implicit rhythm is reflected in the pulsating movement of the visual display.

Apparatus for translating sound into a visual display which apparatus includes a low frequency band pass filter. The audio signals advancing through the low frequency pass band filter are formed into digitized signals that represent the beat of the audio signals. The digitized signals enable digitized processing of the periodic beat rhythm.

Apparatus for translating sound into a visual display in which automatic level control circuits establish voltage levels of the frequency components and the amplitude components of the audio signals for limiting the signals to usable maximum values.

Apparatus for translating sound into a visual display wherein band pass filters advance dominant notes within discrete bands of frequencies of the medium frequency range to reflect the melody of sound. The resulting voltages from the advancing audio signals follow variations in musical tones. The higher the frequency of the tone, the greater the amplitude of the visual display.

DESCRIPTION OF A PREFERRED EMBODIMENT

Figure 1:
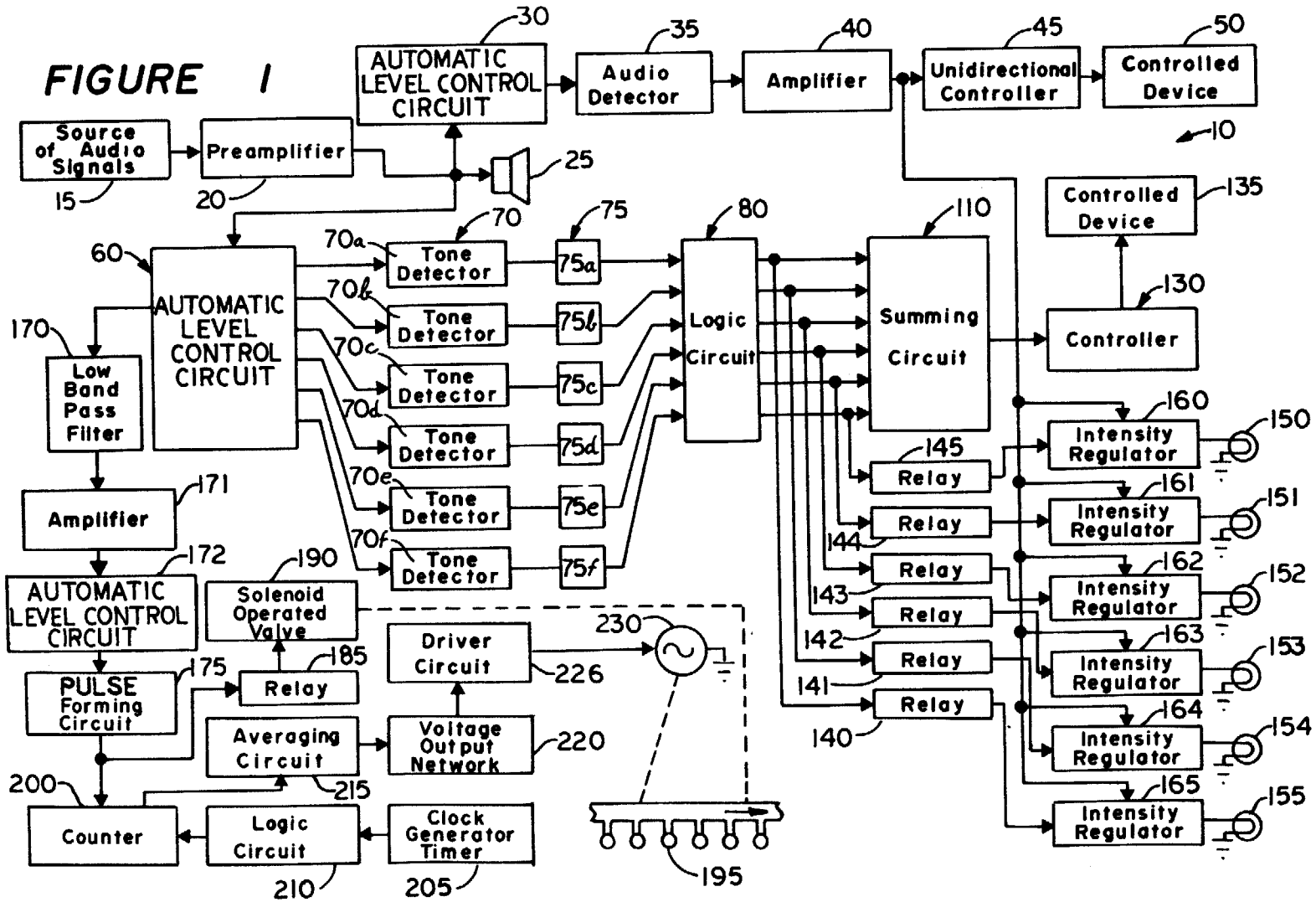
FIG. 1 is a block diagram of apparatus for translating sound into a visual display embodying the present invention.

Illustrated in FIGS. 1 and 2A–2D is apparatus 10 for translating sound into a visual display embodying the present invention. The apparatus 10 comprises a source of audio signals 15, which may be in the form of a microphone 16, a radio 17, a turntable 18, a tape playback player 19, or the like. Audio signals range from about 16 hertz to 20,000 hertz and include the range of voice frequencies within that spectrum. Audio signals representing music contain amplitude variations as one component thereof and frequency variations as another component thereof.

The output of the source of audio signals is amplifed by a suitable pre-amplifier 20. If desired, the output of the pre-amplifier 20 may be connected to a conventional speaker 25. The audio signals from the output of the pre-amplifier 20 travel over a plurality of paths. One of the paths includes a varaiable resistor 27 and a well-known automatic level control circuit 30. The resistor 27 is manually adjustable to attenuate the audio signals, when necessary. The automatic level control circuit 30 automatically adjusts the amplitude of the audio signals to limit the amplitude of the audio signals to a predetermined maximum voltage. In the exemplary embodiment, the automatic level control circuit is a NE570N ALC for preconditioning the signal from the preamplifier 20.

Connected to the output of the automatic level control circuit 30 is a well-known diode detector 35 that includes a diode 36 and a capacitor 37. The diode detector 35 in a well-known manner rectifies the audio signals and in conjunction with the capacitor 37 produces therefrom an envelope representing the amplitude of direct current voltages. The resultant direct current voltage signals are amplified by a suitable amplifier circuit 40. The amplifier circuit 40 includes, in the preferred embodiment, a pair of amplifiers 41 and 42 connected in cascade. The output of the amplifier 40 may vary over a range of voltages from zero voltage to eight volts. The peak signal, in the exemplary embodiment, is eight volts and the minimum voltage may approach zero volts.

In the preferred embodiment, a unidirectional control circuit 45 is connected to the output of the amplifier 40 to turn on and off a controlled device 50, such as a set of nozzles for spraying a liquid. The controlled device 50 is turned on when the unidirectional control circuit 45 receives from the amplifier 40 a signal with an amplitude falling within a prescribed range. The controlled device 50 is turned off when the unidirectional control circuit 45 receives from the amplifier 40 a signal of an amplitude less than the amplitudes of the prescribed range. The unidirectional control circuit 45 is sold by Ledex, Inc., of Dayton, Ohio.

In the exemplary embodiment, the controlled device 50 comprises a solenoid operated servo device 51 which is activated and deactivated by the unidirectional control circuit 45 in response to the amplitude of the signal applied to the unidirectional control circuit 45 and a metering valve 52 that is opened and closed by the solenoid operated servo device 51 to control the flow of liquid from a pump 53 to a group of nozzles 54. The servo device 51 opens the valve 52 when the servo device is activated and closes the valve 52 when the servo device is deactivated. Thus, when the audio signals from the source 15 is of an amplitude within prescribed range, the valve 52 is opened for the flow of liquid from the nozzle 54. When the audio signals from the source 15 is of an amplitude insufficient to fall within a predetermined range, the valve 52 is closed to prevent the flow of liquid from the nozzles 54.

Audio signals from the pre-amplifier 20 are also received by a conventional automatic level control circuit 60. The automatic level control circuit 60 automatically maintains the audio signals at a prescribed voltage level while the amplitude of the signal components of the audio signals will vary with respect to time. Toward this end, the automatic level control circuit 60 includes a network of resistors 61, 62 and 63 to adjustably attenuate the incoming audio signals. The resistor 63 is a manually adjustable variable resistor to preset the effective resistance of the network so that the amplitude of the incoming signal will be within a prescribed range. The output of the network of resistors is applied to a solid state amplifier 64. A diode detector 65 automatically regulates the gain of the amplifier 64 to maintain a relatively constant voltage level, while the amplitude of the signal components of the audio signals will vary with respect to time. In the exemplary embodiment, the automatic level control circuit 60, which may be the well-known NE570N ALC, is used to precondition the signal from the preamplifier 20.

Audio signals in the form of music contain amplitude components and frequency components. The audio signals advanced from the automatic level control circuit 60 contain amplitude components and frequency components. Generally, the melody of music is detected over a three octave band which covers the range from approximately 200 cycles to 1600 cycles with twelve notes in each octave. The audio signals from the output of the automatic level control circuit 60 travel over a plurality of paths. In one path are included a plurality of discrete tone detectors 70. Each tone detector 70 has a different discrete frequency band within the range to detect the melody of the music represented by the audio signals. The tone detectors 70 detect the frequency within the medium range of frequencies to sense the melody of the audio signals. The tone detectors 70 include respective tuning circuits for passing only those frequencies of its preselected band. While the exemplary embodiment discloses six tone detectors **70*a*–70*f*, it is apparent that the number of tone detectors employed will be dependent on the desired level of the refinement and distinctiveness of the visual display of the melody. The frequencies of the range increase for each band detected by the tone detectors 70 in the following order: 70*a*, 70*b*, 70*c*, 70*d*, 70*e* and 70*f***.

Each tone detector **70*a*–70*f*** detects a dominant melody note or a series of dominant adjacent melody notes dependent on the width of the preselected band thereof. When a dominant melody note, or melody notes, is detected, a voltage drop appears across a resistor network in the output thereof to reduce the voltage on the output terminal thereof. In the exemplary embodiment, the voltage at the output terminal thereof is approximately ground potential or a low logic level. In the absence of a dominant melody note or notes, the output of the tone detector at its output terminal will have a voltage of approximately Vt or a high logic level.

Connected to the output terminals of each of the tone detectors **70*a*–70*f*, respectively, is an inverter buffer circuit 75. Thus, the inverter buffer circuits 75*a*–75*f* are connected to the output terminals of the tone detectors 70*a*–70*f*, respectively. The inverter buffers 75** serve to strengthen the signals for further processing and to invert the logic levels of the advancing signals.

A logic circuit 80 is connected to the output circuits of the inverter buffer 75. The logic circuit 80 includes inverter circuits 81–85 and 101, NAND gates 86–90, NOR gates 91–94 and driver amplifier 95–100. The logic circuit 80 is arranged to establish a priority, preemption for the higher tones detected by the tone detectors **70*a*–70*f***.

Should the tone detector **70*f*, which is tuned to the highest band of the range of frequencies, detect a dominant note or notes, then its output will be at a low logic level. The buffer 75*f* inverts the output signal of the detector 70*f* to a high logic level. This action results in the conduction of the driver amplifier 100 for producing an activating signal. The NOR gates 92–94 are rendered non-conductive by the output signal of the buffer 75*f*. The NAND gates 87 and 90 will not conduct because of the output signal of the inverter circuit 85, which inverted the logic level signal from the buffer 75*f*.Thus, the NOR gate 91 and the NAND gate 90 are non-conductive. The inverter circuit 101 does not produce a logic level signal to cause the driver amplifier 98 to produce an activating signal. The non-conductive state of the NOR gates 91–94 will not cause the driver amplifiers 95–97 and 99** to produce an activating signal.

Should the tone detector **70*e*, which is tuned to a band of frequencies lower than the band of frequencies to which the tone detector 70*f* is tuned, detect a dominant note or notes, and the tone detector 70*f* not detect a dominant note or notes, then the inverter circuit 84 will invert the high level logic signal of the buffer circuit 75*e* to a low level logic signal. The low level logic signal is applied to the NOR gate 94. Since the tone detector 70*f* has not sensed any dominant note, its output signal is a high level output signal, which is inverted to a low level logic signal by the buffer circuit 75*f*. The NOR gate 94 conducts to apply a signal to the driver amplifier 99 to produce an activating signal in the output thereof. The low level logic signal from the buffer 75*f* does not operate the driver amplifer 100. The low level logic signal in the output of the inverter circuit 84 prevents the NAND gates 87–89 from conducting. This results in the NOR gates 91–93 being non-conductive. Thus, the driver amplifiers 95–97** do not operate to produce an activating signal.

When the tone detector **70*d*, which is tuned to the band of frequencies lower than the band of frequencies to which the tone detector 70*e* is tuned, detects a dominant note or notes and the tone detectors 70*f* and 70*e* not detect a dominant note or notes, the output of the tone detector 70*d* is at a low logic level. The buffer 75*d* inverts the logic signal to a high level logic signal. As a consequence thereof, the NAND gate 90 conducts and the inverter circuit 101 applies a signal to the driver amplifier 98 to cause the driver amplifier 98 to produce an activating signal in the output thereof. The driver amplifier 100 does not conduct, since the output signal of the tone detector 70*f* is at a high logic level, which is inverted to a low logic signal by the buffer 75*f*. The driver amplifer 99 does not conduct, since the tone detector 70*e* is at a high level, and the signal therefrom is inverted to a low level signal by the buffer 75*e* and the signal is further inverter to a high level signal by the inverter circuit 84. Thus, the NOR gate 94 does not conduct. The high level logic signal from the buffer 75*d* is inverted to a low level logic signal by the inverter circuit 83. The low level logic signals prevent the NAND gates 86, 88 and 89 from conducting regardless of the output logic levels of the tone detectors 70*a*–70*f*. Thus, the NOR gates 91–93 do not conduct and the driver amplifiers 95–97** do not produce an activating signal.

When the tone detector **70 *c*, which is tuned to the band of frequencies lower than the band of frequencies to which the tone detector 70*d* is tuned, detects a dominant note or notes and the tone detectors 70*f*, 70*e* and 70*d* not detect a dominant note or notes, the output of the tone detector 70*c* is at a low logic level. The buffer 75*c* inverts the low logic level signal to a high logic level signal. This action causes the NAND gate 89 to conduct. Thereupon, the NOR gate 93 conducts and the driver amplifier 97 produces an activating signal in the output thereof. Since the tone detector 70*f* produces a high level logic signal in its output, which is inverted to a low level logic signal by the buffer 75*f*, the driver amplifier 100 does not conduct. The high level logic output from the tone detector 70*e* is inverted to a low level logic signal by the buffer 75*e*. The output of the inverter circuit 84 is not at a high potential logic level. The NOR gate 94 does not conduct and, therefore, the driver amplifier 99 does not conduct. The output of the inverter circuit 83 is not at a low level logic signal and, hence, the NAND gates 86, 88 and 89 do not conduct. The NOR gates 91–93 do not conduct and the driver amplifiers 95–97** do not conduct to produce activating signals.

Should the tone detector **70*b*, which is tuned to the band of frequencies lower than the band of frequencies to which the tone detector 70*c* is tuned, detect a dominant note or notes and the tone detectors 70*c*–70*f* not detect a dominant note or notes, then the output of the tone detector 70*b* is at a low logic level. The buffer circuit 75*b* inverts the low level logic signal to a high level logic signal. The NAND gate 88 now conduct and, hence, the NOR gate 92 conducts. The driver amplifier 96 is operated to produce an activating signal in the output thereof. The driver amplifiers 99 and 100 do not conduct as hereinabove described. The output of the inverter circuit 81 is at a low level logic potential to prevent the NAND gate 86 from conducting. This, in turn, prevents the NOR gate 91 from conducting. Thus, the driver amplifier 95 does not operate. The output of the tone detector 70*c* is at a high logic level. The buffer 75*c* inverts the high level logic signal to a low level logic signal. The NAND gate 89 does not conduct and the NOR gate 93 does not conduct. Thus, the driver amplifier 97 is not operated. The output of the tone detector 70*a* is at a high potential. The output of the buffer 75*a* is at a low potential. Thus, the NAND gate 86 does not conduct and the NOR gate 91 does not conduct. Therefore, the driver amplifier 95** does not operate.

When the tone detector **70*a*, which is tuned the lowest band of frequencies of the range of freqencies, detects a dominant note or notes, and the tone detectors 70*b*–70*f* not detect a dominant note or notes, the output thereof is at a low logic level. The buffer 75*a*** inverts the signal to a high logic level.

Thereupon, the NAND gate 86 conducts and the NOR gate 91 conducts. This action causes the driver amplifier 95 to produce an activating signal in its output. The driver amplifiers 98–100 do not conduct for reasons hereinabove described. The output of the tone detector **70*b* is at a high potential and the output of the buffer 75*b* is at a low logic level. The NAND gate 88 does not conduct and the NOR gate 92 does not conduct. Therefore, the driver amplifier 96 does not operate. The output of the buffer 75*c* is at a low logic level and the NAND gate 89 does not conduct. As a consequence thereof, the NOR gate 93 does not conduct and the driver amplifier 97** is not operated.

Connected to the driver amplifiers 95–100 is a summing circuit 110. The summing circuit 110 comprises resistors 115–120, which are connected to the output of the driving amplifiers 95–100, respectively. The resistors 115–120 are input resistors for an amplifier 125 of the summing circuit 110. Thus, the respective output signals from the driver amplifiers 95–120 are applied to the amplifier 125 through the input resistors 115–120, respectively. A feedback resistor 126 interconnects the output of the amplifier 125 with the input thereof.

The value of the resistors 115–120 increase in the numerical order thereof. The lowest resistance value is for the resistor 115 and the highest resistance value is for the resistor 120. The resistors 116–119 increase progressively in resistance value from 116–119. The lowest tuned frequency is represented by the activation of the driver amplifier 95. The highest tuned frequency is represented by the activation of driver amplifier 100.

The activation of the driver amplifiers 96–99, respectively, represent in successive order progressively higher tuned frequencies from amplifiers 96–99. Thus, the activation of the driver amplifiers 95–100, respectively, represent in the numerical order thereof progressivelly higher tuned frequencies.

When the driver amplifier 100 produces an activating signal, current flows through the resistor 120. Similarly, when the driver amplifier 95 is operated, an activating signal flows through the resistors 115. Accordingly, the activating signals from the driver amplifiers 95–100, respectively, flow through the input resistors 115–120, respectively. The higher the resistance of the input resistor through which an activating signal flows, the higher the gain of the amplifier 125. The values of the input resistors 115–120 are such that the higher the frequency that caused the particular input activation, the higher the gain of the summing amplifier 125. The amplitude of the output signal of the summing amplifier 125 is, therefore, a direct function of the band of frequencies over which the tone detectors **70*a*–70*f*** detect a dominant note or notes realizing that higher frequencies receive a priority or a pre-emption in the activating sequence.

Connected to the output of the summing amplifier 125 is a suitable controller 130, which is of the type manufactured by Ledex, Inc., of Dayton, Ohio. From the foregoing, it is apparent that the signal applied to the controller 130 from the summing circuit 110 is a function of the band of frequencies in which the dominant note or notes is detected and the higher the band of frequencies the greater the amplitude of the signal applied to the controller 130.

The controller 130 controls the operation of a controlled device 135. In the preferred embodiment, the controlled device 135 includes an actuator 136, a valve 137 and a bank of nozzles 138. The greater the amplitude of the signal applied to the controller 130 the greater the displacement of the actuator 136. The actuator 136 is coupled to the valve 137, which meters the flow of liquid to a bank of nozzles. The greater the displacement of the actuator 136, the greater the flow of the liquid through the valve 137 to be discharged by the nozzles 138. The nozzles 138 constitute a segment of a fountain display. The higher the frequency range of the detected melody frequencies, the greater the amplitude of liquid discharged from the nozzles 138.

Connected to the output of the driver amplifiers 95–100, respectively, are suitable relays 140–145. The energization of the relays 140–145, respectively, closes contacts **140*a*–145*a*, respectively. By closing contacts 140*a*–145*a*, respectively, intensity regulators 160–165 are activated. The intensity regulators 160–165 are suitable and well-known control transistors. In series with the intensity regulators 160–165, respectively, are suitable lamps 150–155. The lamps 150–155** may be of various colors to reflect a tonal quality of the melody note or notes of the audio signals.

An activating signal in the output of the driver amplifier 100 will energize the relay 145. In so doing, contacts **145*a* close to cause the transistor 165 to conduct for illuminating the lamp 55. In a like manner, an activating signal in the output of the driver amplifier 95 energizes the relay 140. The energization of the relay 140 closes contacts 140*a* to cause the transistor 160 to conduct. The conduction of the transistor 160 serves to illuminate the lamp 150. The lamps 151–153 are illuminated in a similar manner. Thus, the selective illumination of the lmaps 150–155 is related to the band of frequencies over which the tone detectors 70*a*–70*f*** detect a dominant note or notes realizing that higher frequencies receive a priority or a pre-emption on the activating sequence.

For regulating the intensity of illumination of illuminated lamps 150–155, the control transistors 160–165 are connected at the base electrodes thereof to the output of the amplifier 40. Thus, the intensity of illumination of the illuminated lamps will be related to the amplitude of the audio signals.

In another path over which the audio signals are transmitted is included a conventional low band pass filter 170. It has been found that the bass frequencies contain the beat of a musical composition. Rhythm is generally reflected in the lower audio frequencies by instruments, such as the bass fiddle, drums and the like. Thus, the low band pass filter is arranged to pass only the bass frequencies. The low band pass filter 170 is connected to the output of the automatic level control circuit 60 through the amplifier 64 and the rectifier 65.

The bass frequency signals advanced through the filter 170 are amplified by a suitable amplifier 171 and are received by a conventional automatic level control circuit 172. The automatic level control circuit 172 limits the amplitude of the filtered audio in signals to an acceptable level. The automatic level control circuit 172 preconditions the audio signals and is of the type commonly known as the NE57ON ALC.

The output of the automatic level control circuit 172 is connected to a pulse or spike forming circuit 175. The pulse or spike forming circuit 175 produces a pulse or spike each time a beat signal advances through low band pass filter 170. Toward this end, the pulse or spike forming circuit 175 comprises a rectifier 176 to rectify the filtered a.c. low frequency signals to d.c. signals. The d.c. signals are applied to a pulse or spike forming network which includes capacitor 177 capacitor 178, inductance 179, resistors 180–183 and amplifier 184. Across the load resistor 183 a pulse or spike is produced each time a beat signal advances through the low pass band filter 170. The resistance, inductance and capacitance elements of the circuit 175 generates a high Q pulse that is converted into a digitized low frequency, periodic signal. The output of the amplifier 184 reaches saturation upon triggering.

A relay 185 is connected to the output of the pulse or spike forming circuit 175. Each time a pulse or spike is produced by the pulse or spike forming circuit 175, th relay 185 is energized. The relay 185 remains energized for a relatively short time duration.

While the relay 185 is energized, the contacts **185*a* thereof are closed. The closing and opening of the contacts 185*a* opens and closes a solenoid operated valve 190. The valve 190 is an on-off valve. When the valve 190 is opened, liquid flows through a controlled device, such as nozzles 195. When the valve 190 is closed, liquid does not flow through the nozzles 195. Thus, the nozzles 195 discharge liquid in a pulsating manner each time a beat from the audio signals advance through the low band pass filter 170**.

Also connected to the output of the pulse or spike forming circuit 175 is a suitable counting circuit 200, which includes counters 201–202. A suitable clock pulse generator and timing circuit 205 produces clock pulses which are gated through a logic circuit 210 to be applied to the counting circuit 200 as clock pulses for timing the sequential operation of the counting circuit 200.

The clock pulse generator and timing circuit 205 includes a conventional pulse generator, such as crystal controlled solid state pulse generator 206. The output of the clock pulse generator 206 is fed to dual flip-flop circuits 207 and 208. In turn, the output of the flip-flop circuits 207 and 208 is applied to a NAND gate 211 and a NOR gte 212. The logic signal from the NAND gate 211 is inverted by an inverter 213 and applied to the counting circuit 200. Similarly, the logic signal from the NOR gate 212 is inverted by an inverter 214 and applied to the counter 200.

The timing clock pulse from the inveter circuit 213 is at a high logic level during the last moment of a timing period and the timing clock pulse from the inverter circuit 214 is driven to a low logic level a moment thereafter. The count period begins when the signal from the inverter circuit 214 resets the counters 201 and 202 of the counting circuit 200. The digitized signal from the pulse or spike forming circuit 175 generates a binary count of five digits during the timing period established by the periodic resetting of the reset pulse from the inverter circuit 214. Thus, during the time period between two successive reset pulses from the inverter circuit 214, the pulse signal generates a binary count of five digits. The reset pulses emitted from the inverter circuit 214 are timed and controlled by the flip-flop circuits 207 and 208 so that there is one reset pulse from the inverter circuit 214 for each change of state of either the flip-flop 207 or the flip-flop 208.

Immediately prior ot the inverter 214 emitting a resetting pulse to the counters 201 and 202, the inverter 213 emits a set pulse to register circuits 204 and 205' to enable the registers thereof to store the binary count pulses from the counters 201 and 202 at the moment the inverter 213 emits a high level logic signal. The hihg level logic signal emitted from the inverter 213 is of one half of a clock cycle duration. In the exemplary embodiment, the counters 201 and 202 are reset during the first clock pulse cycle. The beat pulses represented by the pulse signals are counted for the following clock pulse cycle by the counters 201 and 202 during the succeeding seven clock pulses cycles. The register circuits 204 and 205 are enabled to store the current binary counting pulses during the seven clock pulse cycles plus any update that occurs during the eighth or last clock pulse cycel. On the succeeding clock pulse cycle, which is the first clock pulse cycle, the register circuits 204 and 205' are disabled so that the transferred count of the register circuits 204 and 205' is held for seven clock pulse cycles and the counters 201 and 202 are reset so that the counting cycle can be repeated.

From the foregoing it is to be observed that the counter 200 is a binary counter, in the preferred embodiment, employed to count the number of bass pulses for a prescribed period of time. In the exemplary embodiment, six second timing periods are employed. At the end of a six second period, the binary representation of the counted pulses is transferred to the registers 204 and 205' where the transfer has approximately one second for execution. At the end of the reset time, the output registers 204 and 205' contain the count of the last timing period and are disabled so that they hold the count of the last timing period until the end of the following timing period.

The registers 204 and 205 are enabled and disabled to accept updating in a cyclic fashion. The digital count present in the output registers 204 and 205' is converted to an analog output in the voltage network 220, since the varying voltage applied to the driver circuit 226 reflects the number of pulses per timing period. The five digit output from the register circuits 204 and 205' are fed to a conventional averaging circuit 215, which in a well-known manner maintains a running average of the previous counts with the current count. The output of the averaging circuit 215 is applied to a voltage output network 220 that includes resistors 221–225. The voltage output network 220 establishes an output voltage of an amplitude that is proportional to the count on the averaged count.

The output voltage from the voltage output network 220 is applied to a driver circuit 226 in the form of a control transistor. The control transistor 226 controls the speed at which a variable speed motor 230 operates. Through a set of mechanical linkages, the variable speed motor 230 actuates the nozzles 195 so that the movement of the nozzles is correlated to the beat frequency or rhythm of the audio signals. Thus, the flow of liquid through the nozzles 195 is related to the melody of the audio signals and the movement of the nozzles 195 is related to the beat frequency of the audio signals. The movement of the nozzles 195 can be either oscillatory in nature or rotational in nature.

The detecting of the low frequency notes representing the beat of a drum, the plucking of a bass fiddle, the excitation of the low frequency strings of a piano via the low band pass filter 170 constitute the explicit rhythm of the audio signals. The implicit rhythm constitutes the tempo of the audio signals. The present invention recaptures visually the tempo of the audio signals as well as reflect the explicit rhythmic beats. The implicit rhythm is reflected by a cyclic movement of the spray of liquid from the nozzles 195 through the oscillatory movement or rotation movement imparted to the nozzles 195 through the variable speed motor 230. The explicit rhythm is reflected through the pulsating discharge of liquid from the nozzles 195 through the action of solenoid operated valve 190.

For imparting oscillatory movement to the nozzles 195, the nozzles 195 are pivotally supported by a fixed conduit 250 that conducts liquid to the nozzles 195. The nozzles 195 are connected to a reciprocating shaft 251. For imparting a reciprocating movement to the shaft 251 to oscillate the nozzles 195, the shaft of the motor 230 rotates a worm gear that meshes with a gear 252. The gear 252 is fixed to a slider crank mechanism 254. The reciprocating shaft 251 is connected to the slider crank mechanism through a suitable bearing. Thus, rotation of the gear 252 imparts a reciprocating movement to the shaft 251 through the slider crank mechanism 254. The speed of the motor 230 is a function of the averaged beat count so that the sway of the nozzles 195 reflects the inherent rhythm of the music.

Figure 2A:
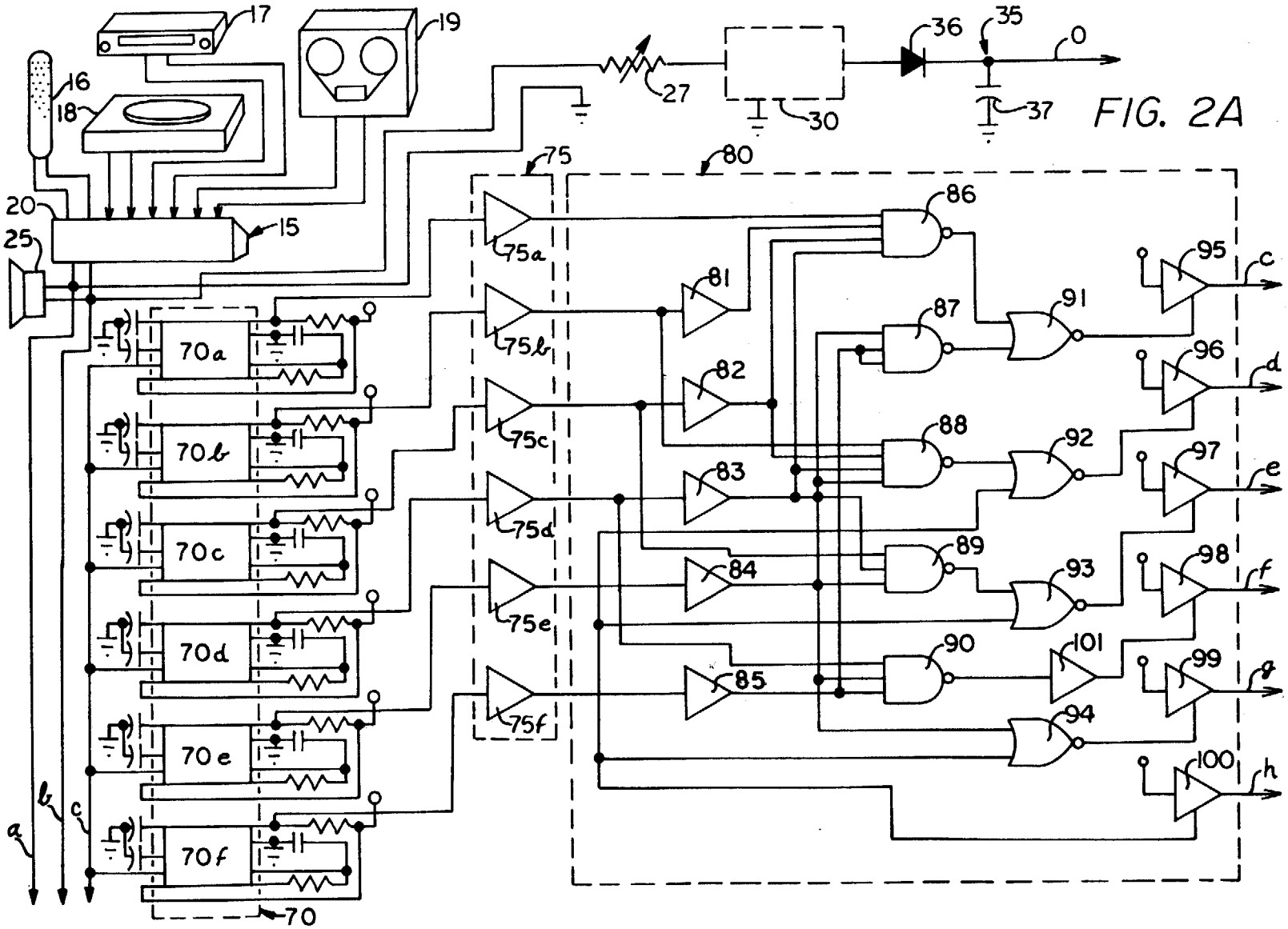
FIGS. 2A–2D, when placed in the manner shown in FIG. 2E, are a schematic diagram of apparatus shown in FIG. 1.
Figure 2B:
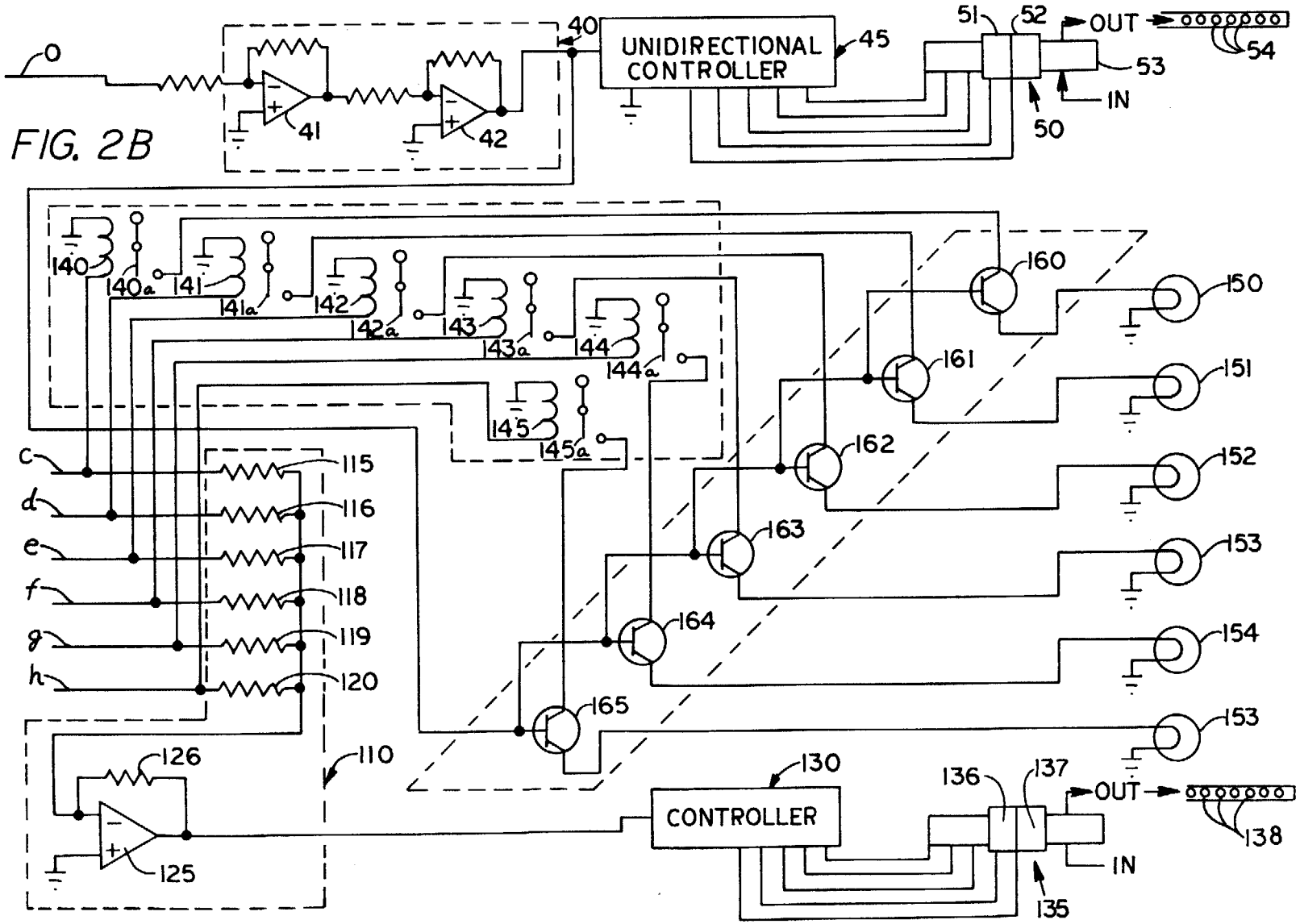
Figures 2C, 2E:
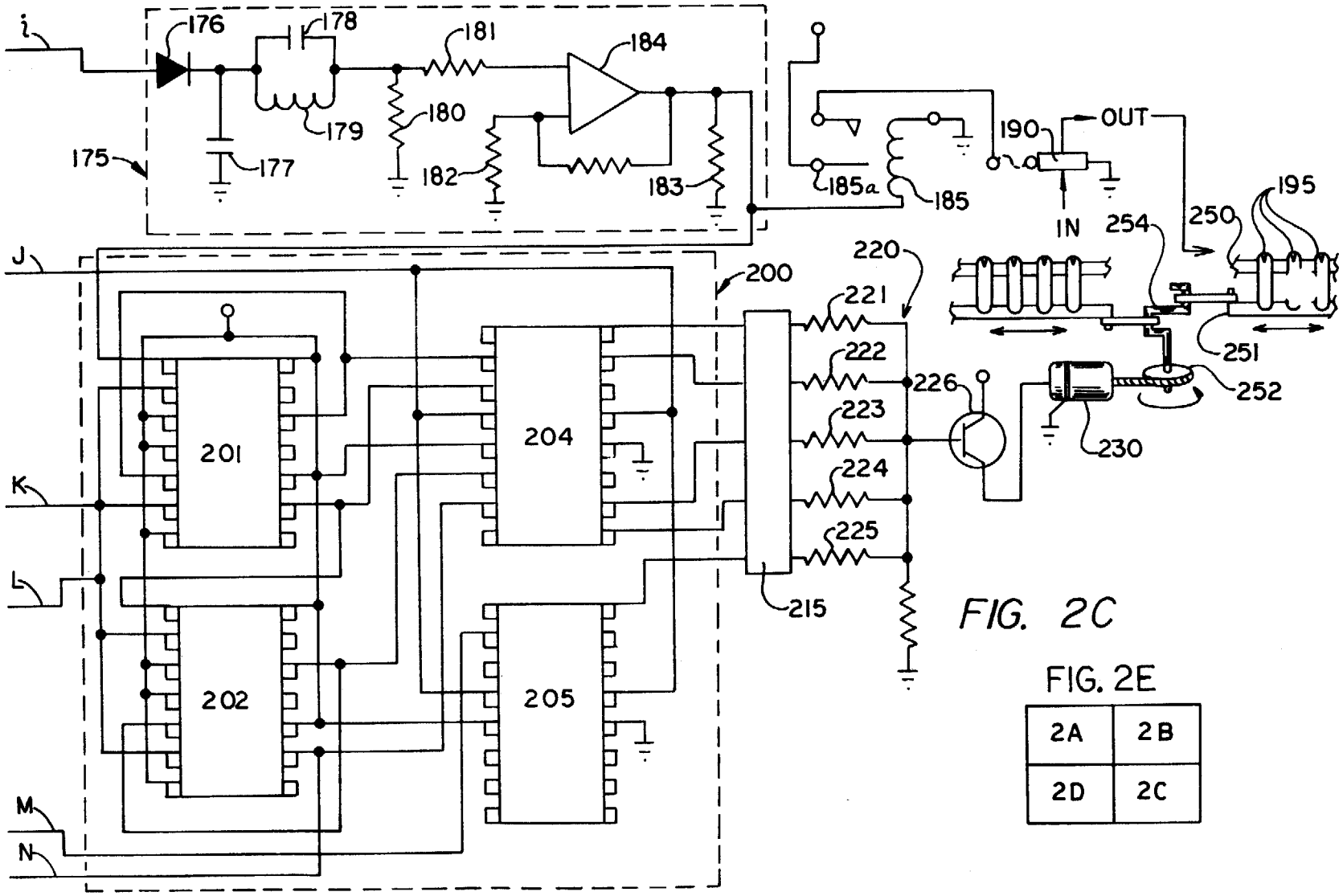
Figure 2D:
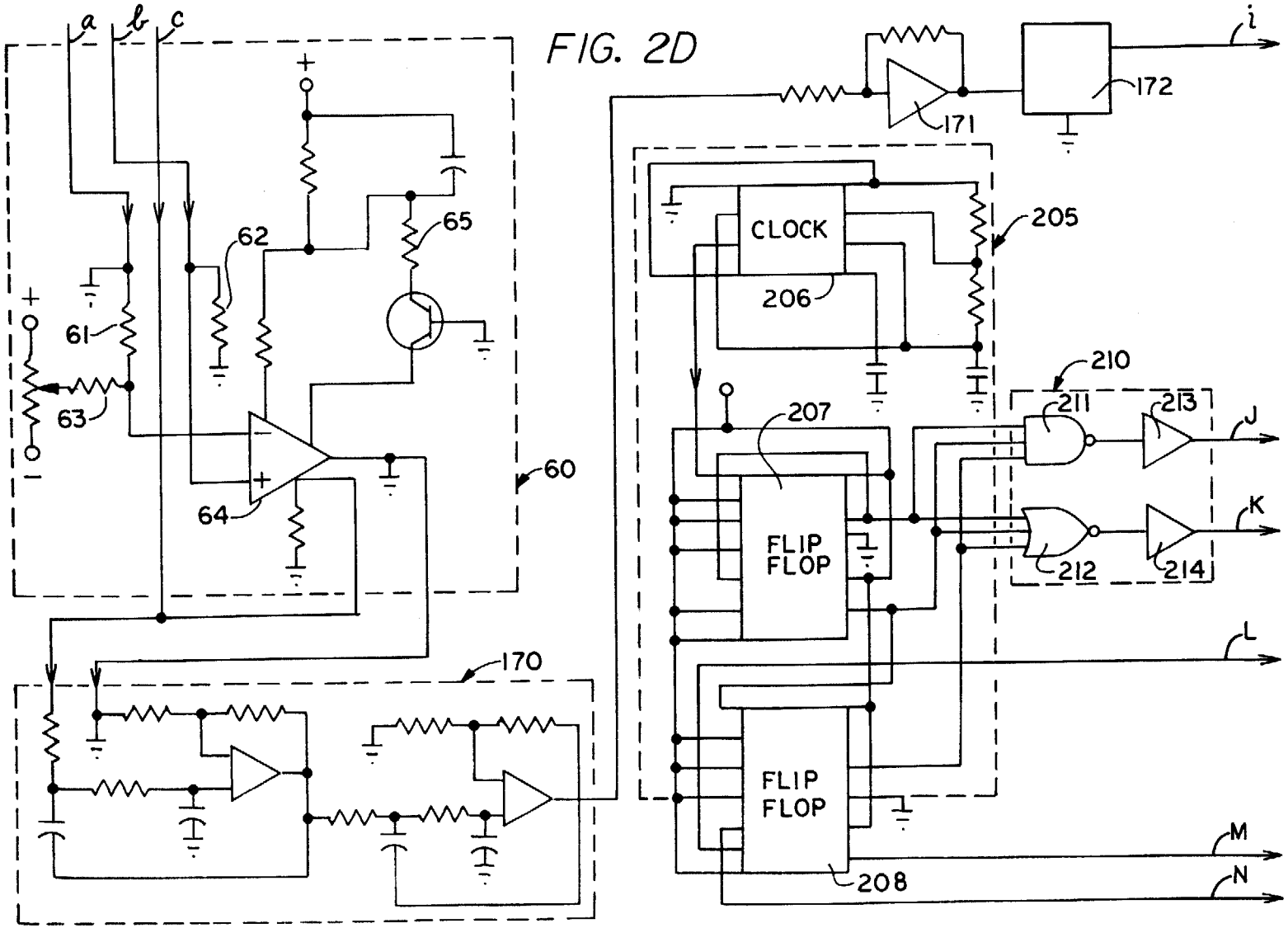
Figure 3A:
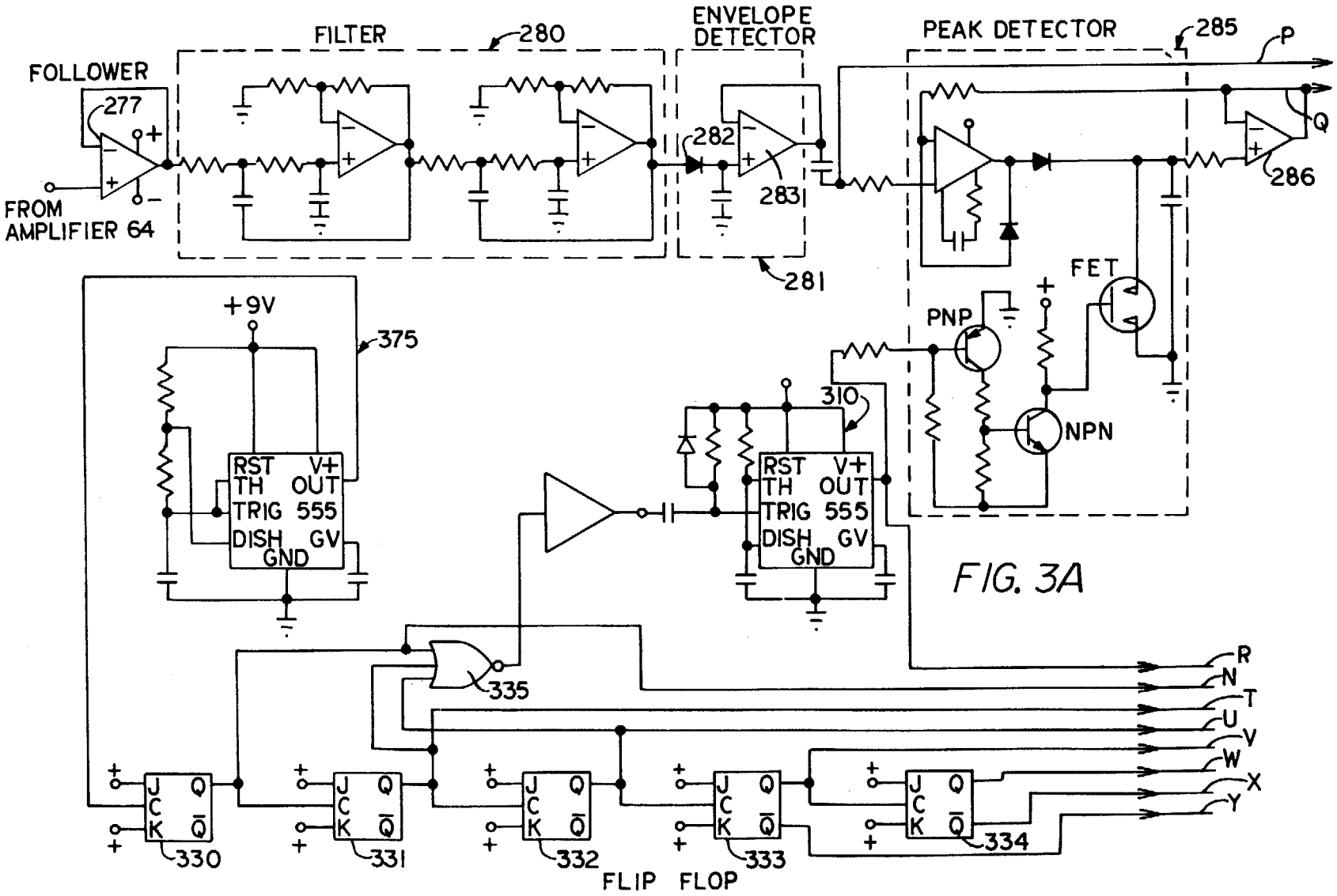
FIGS 3A and 3B, when placed side-by-side are a modification of the circuit for displaying the beat rhythm.
Figure 3B:
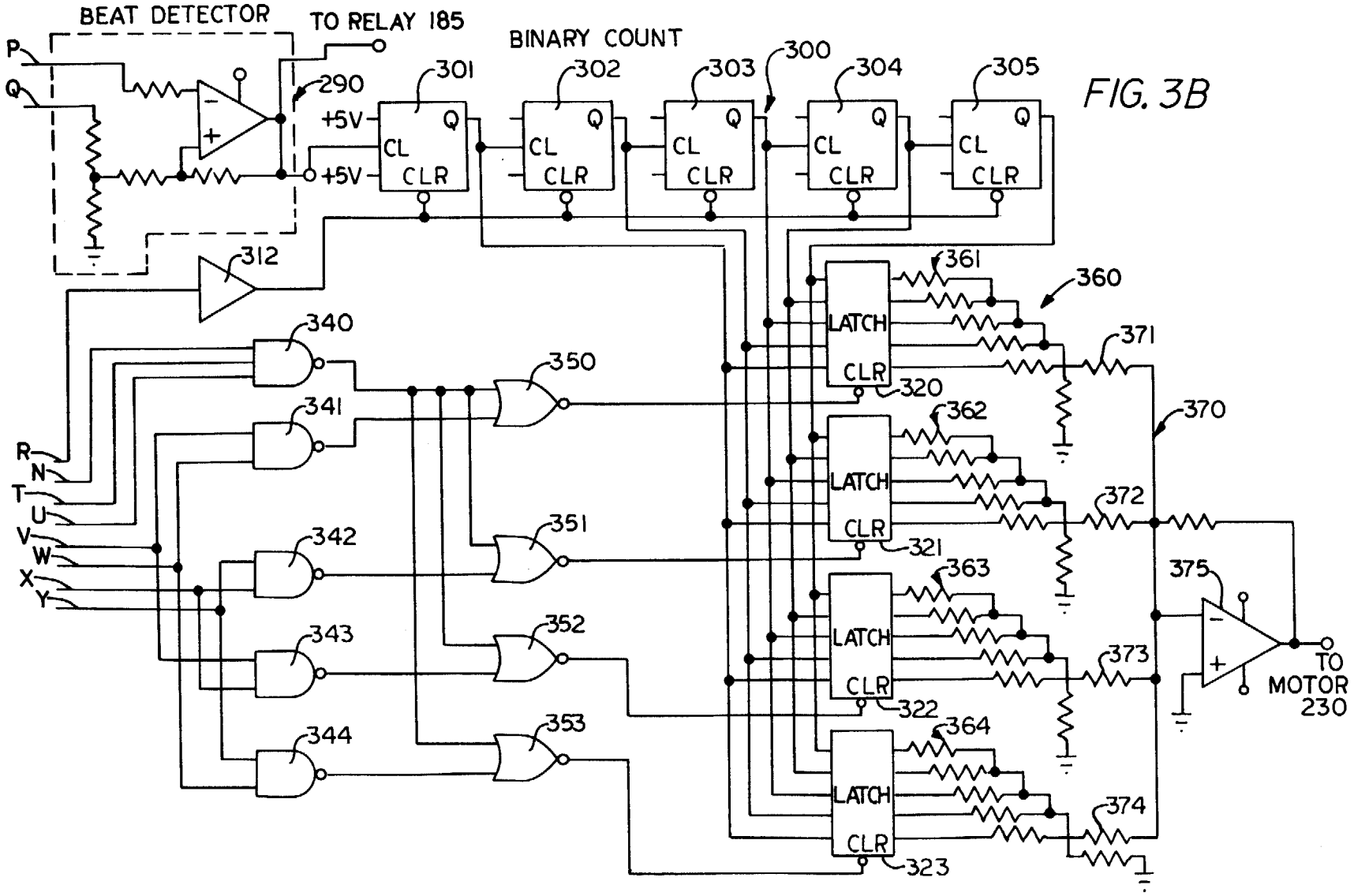

Illustrated in FIGS. 3A and 3B is a rhythm circuit 275, which is a modification of the rhythm circuit shown in FIGS. 2A–2D for displaying the beat rhythm. The circuit 275 for displaying the beat rhythmn is connected to the automatic level control circuit 60 through the audio amplifier 64. Included in the circuit 275 is a suitable follower circuit 277. Connected to the output of the follower circuit 277 is a low band pass filter 280. The low band pass fitler 280 is arranged to pass only the bass frequencies and is similar to the previously described low band pass filter 170.

An envelope detector 281 in the form of a diode detector is connected to the output of the low band pass filter 280 to rectify the audio signals for producing pulsating d.c. signals in the low frequency range. The envelope detector 281 includes a diode 282 and an amplifier 283. Connected to the output of the envelope detector 281 is a variable detection threshold peak detector 285. The output of the peak detector produces an output voltage which approximates the peak value of each applied signal.

For digitizing the signal output from the peak detector 285, a beat detector 290 is connected to the output of the peak detector 285 through an amplifier 286. The digitized signals from the beat detector 290 is applied to a suitable binary counter circuit 300. The binary counter circuit 300 includes 5 bit counters 301-305. A suitable pulse generator and timing circuit 310 generates clock pulses for sequentially advancing the beat signals through the 5 bit counters 301-305 and also for timing the operation of the peak detector 285. An inverter circuit 312 is disposed between the clock pulse generator and timing circuit 310 and the counters 301-305. The counters 301-305 and the peak detector 285 are reset every preselected time interval.

By employing a variable detection threshold peak detector and resetting the peak detector at preselected time intervals, a more reliable beat detection is achieved. The time interval for resetting the peak detector is selected to detect a minimum number of beats. The variable threshold voltage at which the peak detector produces each beat signal during each time period respectively is determined by the averaging of the peak voltages detected by the beat detector during a prescribed period of time, which may be two timing periods in duration.

Connected to the 5 bit counters 301-305 are latch circuits 320-323. The count in the binary counters 301-305 are transferred in parallel to one of the 5 bit latch circuits 320-323 prior to the resetting of the binary counters 301-305. The averaged period for resetting the latch circuits 320-323 is four times the preselected time interval for resetting the counters 301-305. Each latch is reset to reflect every fourth counting period counting in sequence. At any given time, the last four counting period counts are digitally contained in the latch circuits 320-323.

For clearing the latch circuits 320-323, a clock pulse generator and timing circuit 325 applies clock pulses in sequence to JK flip-flop circuits 330-334. The clock pulse generator 310 operates in timed sequence with the clock pulse generator 325 through the flip-flop circuit 330 and the NOR gate 335. NAND gates 340-344 and NOR gates 350-353 serve to clear the latch circuits 320-323 in sequence in response to the sequential operation of the flip-flop circuits 330-334.

The output of the latch circuits 320-323 is analogued and averaged by an averaging circuit 360. The averaging circuit 215 shown as a block in FIG. 2B is similar to the averaging circuit 360. There are four averaging networks 361-364 in the averaging circuit 360. The averaging networks 361-364 are connected to the output of the latch circuits 320-323, respectively. In each averaging network, the resistance of each resistor is multiplied by 2 in descending order in the exemplary embodiment. For example, the uppermost resistor is a 1K ohm resistor, the second resistor is a 2K ohm resistor, the third resistor is a 4K ohm resistor, the fifth resistor is a 8K ohm resistor, and the lowermost resistor is a 16K ohm resistor.

The digital count present in the latch circuits 320-323 is converted to analog output in a voltage network 370, which includes resistors 371-374. The output of the voltage network 370 is applied to a driver circuit 375 for operating the rhythm motor 230. The varying voltage applied to the driver circuit 225 reflects the number of pulses per timing period.

The output of the peak detector 290 is also applied to the relay 185 (FIG. 2C) for energizing and deenergizing the same. The opening and closing of the relay contacts **185*a* serve to open and close the solenoid operated valve 190. This action results in controlling the flow of liquid through the nozzles 195 so that the nozzles 195** discharge liquid in a pulsating manner in accordance with the bass pulse beat.

I claim:

1. Apparatus for translating sound into a visual display, said sound comprising a band of frequencies over which appear the rhythmic tones, said apparatus comprising:

(a) means for producing audio signals;

(b) filter means responsive to said audio signals for advancing signals of the frequencies of the band over which appear the rhythmic tones;

(c) pulse forming means connected to said filter means and responsive to said signals of the frequencies of the band over which appear the rhythmic tones for producing pulse signals representative of the beat of the rhythmic tones;

(d) visual means; and (e) circuit means responsive to said pulse signals representative of the beat of the rhythmic tones and counting said pulse signals within timing periods, the respective counts of the number of pulse signals counted within the respective timing periods producing output voltage levels which are proportional to the beat of the rhythmic tones for varying said visual means in rhythm with said rhythmic tones.

2. Apparatus as claimed in claim 1 wherein said circuit means comprises a first circuit responsive to said signals representing the beat of the rhythmic tones for operating said visual means in rhythm with said rhythmic tones and wherein said circuit means comprises a second circuit responsive to said signals representing the beat of the rhythmic tones for varying said visual means in a pulsating manner in rhythm with said rhythmic tones.

3. Apparatus as claimed in claim 2 and comprising a circuit interposed between said means responsive to said audio signals and said filter means for producing signals representative of the beat of the rhythmic tones for limiting said signals representative of the beat of the rhythmic tones to a predetermined level.

4. Apparatus as claimed in claim 1 and comprising a circuit interposed between said means for producing audio signals and said filter means responsive to said audio signals for limiting the amplitude of said audio signals to a predetermined level.

5. Apparatus as claimed in claim 3 and comprising a circuit interposed between said means responsive to said audio signals and said filter means for producing signals representative of the beat of the rhythmic tones for limiting said signals representative of the beat of the rhythmic tones to a predetermined level.

6. Apparatus as claimed in claim 1 wherein said sound also comprises a range of frequencies over which appear melody notes, said apparatus further comprising:

(a) a plurality of tone detectors receiving said audio signals, each of said tone detectors being arranged to pass frequencies within a discrete band of frequencies within said range, each of said band of frequencies covering a discrete portion of said range with respect to the remaining bands of frequencies, each of said tone detectors producing an output voltage in response to the detection of a dominant note within its band of frequencies;

(b) a logic circuit responsive to the voltages produced by said tone detectors, said logic circuit including a plurality of devices selectively operated in accordance with the voltages produced by said tone detectors;

(c) means connected to said devices for producing a voltage of a magnitude associated with the operation of one of said devices; and (d) means operated in accordance with the magnitude of the voltage produced by said means connected to said devices to visually display a representation of the melody of said audio signals.

7. Apparatus as claimed in claim 6 and further comprising a controlled device, and circuit means responsive to the amplitude of said audio signals for operating said controlled device to vary said controlled device in accordance with variations in the amplitude of said audio signals.

8. Apparatus for translating sound into a visual display, said sound comprising a band of frequencies over which appear the rhythmic tones, said apparatus comprising:

(a) means for producing audio signals;

(b) means responsive to said audio signals for advancing signals of the frequencies of the band over which appear the rhythmic tones;

(c) means responsive to said signals of the frequencies of the band over which appear the rhythmic tones for producing signals representative of the beat of the rhythmic tones;

(d) visual means; and (e) circuit means responsive to said signals representative of the beat of the rhythmic tones for varying said visual means in rhythm with said rhythmic tones, (f) said circuit means comprising a first circuit responsive to said signals representing the beat of the rhythmic tones for operating said visual means in rhythm with said rhythmic tones, said circuit means comprising a second circuit responsive to said signals representing the beat of the rhythmic tones for varying said visual means in a pulsating manner in rhythm with said rhythmic tones;

(g) said second circuit comprising counters to count said signals representative of the beat of the rhythmic tones, a clock pulse timing circuit connected to said counters whereby said counters count the number of signals representative of the beat of the rhythmic tones within each timing period, a circuit connected to said counters and said clock pulse timing circuit for storing the signals representative of the beat of the rhythmic tones for each timing period, and activating means interconnecting said circuit for storing signals representative of the beat of the rhythmic tones for each timing period, and said visual means for varying said visual means in a manner proportional to the count during each timing period.

9. Apparatus as claimed in claim 8 wherein said activating means includes a voltage network to establish an output voltage of an amplitude proportional to the count during each timing period.

10. Apparatus as claimed in claim 8 wherein said activating means includes a voltage network to establish an output voltage of an amplitude proportional to the count during each timing period.

11. Apparatus as claimed in claim 10 wherein said circuit means comprises an envelope detector for converting the output of said band pass filter to pulsating signals representative of the beat of the rhythmic tones.

12. Apparatus as claimed in claim 11 wherein said circuit means comprises a peak detector connected to the output of said envelope detector for producing signals representative of the beat of the rhythmic tones approximately the peak value of the pulsating signals produced by said envelope detector.

13. Apparatus as claimed in claim 12 wherein said circuit means comprises a beat detector connected to the output of said peak detector for producing digitized signals representative of the beat of the rhythmic tones, said digitized signals being applied to said counter circuits.

14. Apparatus as claimed in claim 13 wherein said peak detector is a variable detection threshold peak detector and said clock pulse timing circuit is connected to said peak detector for resetting said peak detector at preselected time intervals.

15. Apparatus for translating sound into a visual display, said sound comprising a range of frequencies over which appear melody notes, said apparatus comprising:

(a) means for producing audio signals;

(b) a plurality of tone detectors receiving said audio signals, each of said tone detectors being arranged to pass frequencies within a discrete band of frequencies within said range, each of said band of frequencies covering a discrete portion of said range with respect to the remaining bands of frequencies, each of said tone detectors producing an output voltage in response to the detection of a dominant note within its band of frequencies;

(c) a logic circuit responsive to the voltages produced by said one detectors, said logic circuit including a plurality of devices selectively operated in accordance with the voltages produced by said tone detectors;

(d) means connected to said devices for producing a voltage of a magnitude associated with the operation of one of said devices, said means connected to said devices include a summing circuit, whereby the voltage produced by said means connected to said devices is a function of the band of frequencies of the tone detector operating one of said devices so that the higher the frequency of the tone detector operating one of said devices, the greater the amplitude of the voltage produced by said means connected to said devices; and (e) means operated in accordance with the magnitude of the voltage produced by said means connected to said devices to visually display a representation of the melody of said audio signals.

16. Apparatus for translating sound into a visual display, said sound comprising a range of frequencies over which appears melody notes, said apparatus comprising:

(a) means for producing audio signals;

(b) a plurality of tone detectors receiving said audio signals, each of said tone detectors being arranged to pass frequencies within a discrete band of frequencies within said range with respect to the remaining bands of frequencies, each of said tone detectors producing an output voltage in response to the detection of a dominant note within its band of frequencies;

(c) a logic circuit responsive to the voltages produced by said tone detectors, said logic circuit including a plurality of devices selectively operated in accordance with the voltages produced by said tone detectors, said logic circuit including circuit means for giving priority to the tone detector of a higher frequency band in selectively operating one of said devices;

(d) means connected to said devices for producing a voltage of a magnitude associated with the operation of one of said devices, said means connected to said devices including a summing circuit, whereby the voltage produced by said means connected to said devices is a function of the band of frequencies of the tone detector operating one of said devices so that the higher the frequency of the tone detector operating one of said devices, the greater the amplitude of voltage produced by said means connected to said devices; and (e) means operated in accordance with the magnitude of the voltage produced by said means connected to said devices to visually display a representation of the melody of said audio signals.

17. Apparatus for translating sound into a visual display, said sound comprising a range of frequencies over which appears melody notes, said apparatus comprising:

(a) means for producing audio signals;

(b) a plurality of tone detectors receiving said audio signals, each of said tone detectors being arranged to pass frequencies within a discrete band of frequencies within said range, each of said band of frequencies covering a discrete portion of said range with respect to the remaining bands of frequencies, each of said tone detectors producing an output voltage in response to the detection of a dominant note within its band of frequencies;

(c) a logic circuit responsive to the voltages produced by said tone detectors, said logic circuit including a plurality of devices selectively operated in accordance with the voltages produced by said tone detectors;

(d) means connected to said devices for producing a voltage of a magnitude associated with the operation of one of said devices;

(e) means operated in accordance with the magnitude of the voltages produced by said means connected to said devices to visually display a representation of the melody of said audio signals, said means operated in accordance with the magnitude of the voltage produced by said means connected to said devices includes nozzles for spraying a liquid so that the extent of the spray is representative of the melody of said audio signals;

(f) a plurality of lamps selectively operated in accordance with the selective operation of said devices for visually displaying a representation of the melody of said audio signals; and (g) means interconnecting said lamps with said means for producing audio signals for controlling the intensity of illumination of the selectively operated lamps in accordance with the amplitude of said audio signals.

18. Apparatus for translating sound into a visual display, said sound comprising a band of frequencies over which appear the rhythmic tones, said apparatus comprising:

(a) means for producing audio signals;

(b) means responsive to said audio signals for advancing signals of the frequencies of the band over which appear the rhythmic tones;

(c) means responsive to said signals of the frequencies of the band over which appear the rhythmic tones for producing signals representative of the beat of the rhythmic tones;

(d) visual means; and (e) circuit means responsive to said signals representative of the beat of the rhythmic tones for varying said visual means in rhythm with said rhythmic tones, said circuit means comprising counters to count said signals representative of the beat of the rhythmic tones, a clock pulse timing circuit connected to said counters whereby said counters count the number of signals representative of the beat of the rhythmic tones within each timing period, a circuit connected to said counters and said clock pulse timing circuit for storing signals representative of the beat of the rhythmic tones for each timing period, and activating means interconnecting said circuit for storing signals representative of the beat of the rhythmic tones and said visual means for varying said visual means in a manner proportional to the count during each timing period.

19. Apparatus for translating sound into a visual display, said sound comprising a band of frequencies over which appear the rhythmic tones, said sound also comprises a range of frequencies over which appear melody notes, said apparatus comprising:

(a) means for producing audio signals;

(b) filter means responsive to said audio signals for advancing signals of the frequencies of the band over which appear the rhythmic tones;

(c) pulse forming means connected to said filter means and responsive to said signals of the frequencies of the band over which appear the rhythmic tones for producing pulse signals representative of the beat of the rhythmic tones;

(d) visual means;

(e) circuit means responsive to said pulse signals representative of the beat of the rhythmic tones for producing pulse signals representative of the beat of the rhythmic tones;

(f) a plurality of tone detectors receiving said audio signals, each of said tone detectors being arranged to pass frequencies within a discrete band of frequencies within said range, each of said band of frequencies covering a discrete portion of said range with respect to the remaining band of frequencies, each of said tone detectors producing an output voltage in response to the detection of a dominant note within its band of frequencies;

(g) a logic circuit responsive to the voltages produced by said tone detectors, said logic circuit including a plurality of devices selectively operated in accordance with the voltages produced by said tone detectors, said logic circuit including circuit means for giving priority to the tone detector of a higher frequency band in selectively operating one of said devices;

(h) means connected to said devices for producing a voltage of a magnitude associated with the operation of one of said devices; and (i) means operated in accordance with the magnitude of the voltage produced by said means connected to said devices to visually display a representation of the melody of said audio signals.

20. Apparatus for translating sound into a visual display, said sound comprising a band of frequencies over which appear the rhythmic tones and said sound comprising a range of frequencies over which appear melody notes, said apparatus comprising:

(a) means for producing audio signals;

(b) means responsive to said audio signals for advancing signals of the frequencies of the band over which appear the rhythmic tones;

(c) means responsive to said signals of the frequencies of the band over which appear the rhythmic tones for producing signals representative of the beat of the rhythmic tones;

(d) visual means;

(e) circuit means responsive to said signals representative of the beat of the rhythmic tones for varying said visual means in rhythm with said rhythmic tones;

(f) a plurality of tone detectors receiving said audio signals, each of said tone detectors being arranged to pass frequencies within a discrete band of frequencies within said range, each of said band of frequencies covering a discrete portion of said range with respect to the remaining bands of frequencies, each of said tone detectors producing an output voltage in response to the detection of a dominant note within its band of frequencies;

(g) a logic circuit responsive to the voltages produced by said tone detectors, said logic circuit including a plurality of devices selectively operated in accordance with the voltages produced by said tone detectors, said logic circuit including circuit means for giving priority to the tone detector of a higher frequency band in selectively operating one of said devices;

(h) means connected to said devices for producing a voltage of a magnitude associated with the operation of one of said devices, said means connected to said devices including a summing circuit, whereby the voltage produced by said means connected to said devices is a function of the band of frequencies of the tone detector operating one of said devices so that the higher the frequency of the tone detector operating one of said devices, the greater the amplitude of voltage produced by said means connected to said devices.

21. Apparatus as claimed in claim 20 wherein said circuit means comprises counters to count said signals representative of the beat of the rhythmic tones, a clock pulse timing circuit connected to said counters whereby said counters count the number of signals representative of the beat of the rhythmic tones within each timing period, a circuit connected to said counters and said clock pulse timing circuit for storing signals representative of the beat of the rhythmic tones for each timing period, and activating means interconnecting said circuit for storing signals representative of the beat of the rhythmic tones and said visual means for varying said visual means in a manner proportional to the count during each timing period.

22. Apparatus as claimed in claim 21 wherein said activating means includes a voltage network to establish an output voltage of an amplitude proportional to the count during each timing period.

23. Apparatus as claimed in claim 22 wherein said circuit means comprises an envelope detector for converting the output of said band pass filter to pulsating signals representative of the beat of the rhythmic tones.

24. Apparatus as claimed in claim 23 wherein said circuit means comprises a peak detector connected to the output of said envelope detector for producing signals representative of the beat of the rhythmic tones approximately the peak value of the pulsating signals produced by said envelope detector.

25. Apparatus as claimed in claim 24 wherein said circuit means comprises a beat detector connected to the output of said peak detector for producing digitized signals representative of the beat of the rhythmic tones, said digitized signals being applied to said counter circuits.

26. Apparatus as claimed in claim 25 wherein said peak detector is a variable detection threshhold peak detector and said clock pulse timing circuit is connected to said peak detector for resetting said peak detector at preselected time intervals.

27. Apparatus as claimed in claim 20 and further comprising a controlled device, and circuit means responsive to the amplitude of said audio signals for operating said controlled device to vary said controlled device in accordance with variations in the amplitude of said audio signals.

28. Apparatus for translating sound into a visual display, said sound comprising a band of frequencies over which appear the rhythmic tones, said apparatus comprising:

(a) means for producing audio signals;

(b) filter means responsive to said audio signals for advancing signals of the frequencies of the band over which appear the rhythmic tones;

(c) first circuit means responsive to said signals of the frequencies of the band over which appear the rhythmic tones for setting during a period of time a threshold voltage from peak signal amplitudes proportionate in amplitude to the peak signal amplitudes detected during the period of time, said first circuit means establishes a threshold voltage successively commencing with each successive period of time, each threshold voltage is established independently of the magnitude of any preceding threshold voltage, said first circuit means being responsive to signals within each period of time respectively of the frequencies of the band, over which appear the rhythmic tones, having an amplitude greater than the threshold voltage established during the immediately preceding period of time for producing signals representative of the beat of the rhythmic tones;

(d) visual means; and (e) second circuit means responsive to said signals representative of the beat of the rhythmic tones for varying said visual means in rhythm with rhythmic tones.

29. Apparatus as claimed in claim 28 wherein said first circuit means comprises an envelope detector for converting the output of said filter means to pulsating signals representative of the beat of the rhythmic tones.

30. Apparatus as claimed in claim 29 wherein said first circuit means comprises a peak detector connected to the output of said envelope detector for producing signals representative of the beat of the rhythmic tones approximately equal to the peak value of the pulsating signals produced by said envelope detector.

31. Apparatus as claimed in claim 30 wherein said first circuit means comprises a beat detector connected to the output of said peak detector for producing digitized signals representative of the beat of the rhythmic tones.

32. Apparatus as claimed in claim 31 wherein said peak detector is a variable detection threshold peak detector, said first circuit means further comprising a timing circuit connected to said peak detector for resetting said peak detector at preselected time intervals.

* * * * *